United States Patent [19]

Donnard et al.

[11] 4,077,147

[45] Mar. 7, 1978

[54] UNDERWATER SIDE ARM

[76] Inventors: Reed E. Donnard, 417 Emerson Rd., Huntingdon Valley, Pa. 19006; Edward R. Hirsekorn, 3111 Brighton St., Philadelphia, Pa. 19149

[21] Appl. No.: 169,153

[22] Filed: Jan. 26, 1962

[51] Int. Cl.[2] ..... F41C 3/00; F42B 5/00

[52] U.S. Cl. ..... 42/1 L; 42/8; 42/76 R; 102/38

[58] Field of Search ..... 42/8, 2, 1, 1 MC, 39.5, 42/76, 78; 89/5; 102/38

[56] References Cited

U.S. PATENT DOCUMENTS

| | | | |
|---|---|---|---|
| Re. 18,252 | 11/1931 | Alden | 102/38 |
| 47,755 | 5/1865 | Sneider | 42/8 |
| 256,041 | 4/1882 | Pierce | 42/8 |
| 391,367 | 10/1888 | Hurst | 42/76 |
| 628,142 | 7/1899 | Ericson | 42/8 |
| 1,994,294 | 3/1935 | Williams | 42/2 |
| 2,061,835 | 11/1936 | Haines | 102/38 |
| 2,089,219 | 8/1937 | Moore | 42/78 |
| 2,777,391 | 1/1957 | McNally | 102/38 |
| 2,847,784 | 8/1958 | Dardick | 42/39.5 |
| 2,906,175 | 9/1959 | Mohaupt | 42/1 |

FOREIGN PATENT DOCUMENTS

| | | | |
|---|---|---|---|
| 80,060 | 3/1895 | Germany | 102/41 |
| 2,422 of | 1888 | United Kingdom | 42/8 |

*Primary Examiner*—Charles T. Jordan
*Attorney, Agent, or Firm*—Nathan Edelberg; A. Victor Erkkila; Max Yarmovsky

EXEMPLARY CLAIM

1. A device including an expendable cartridge-barrel assembly comprising a cartridge casing forming a barrel, the wall thickness of said barrel being at least equal to about the diameter of the bore therein, a retainer affixed to and rearwardly of said casing, a high energy propellant enclosed within said assembly, a primer within said retainer and communicating with said propellant, a projectile frictionally fitted within and extending along the bore of said barrel and having a rear end in proximate relation to said propellant, said projectile being designed for high sectional density and minimum drag with water, and a watertight seal affixed to a front end of said cartridge-barrel assembly.

8 Claims, 4 Drawing Figures

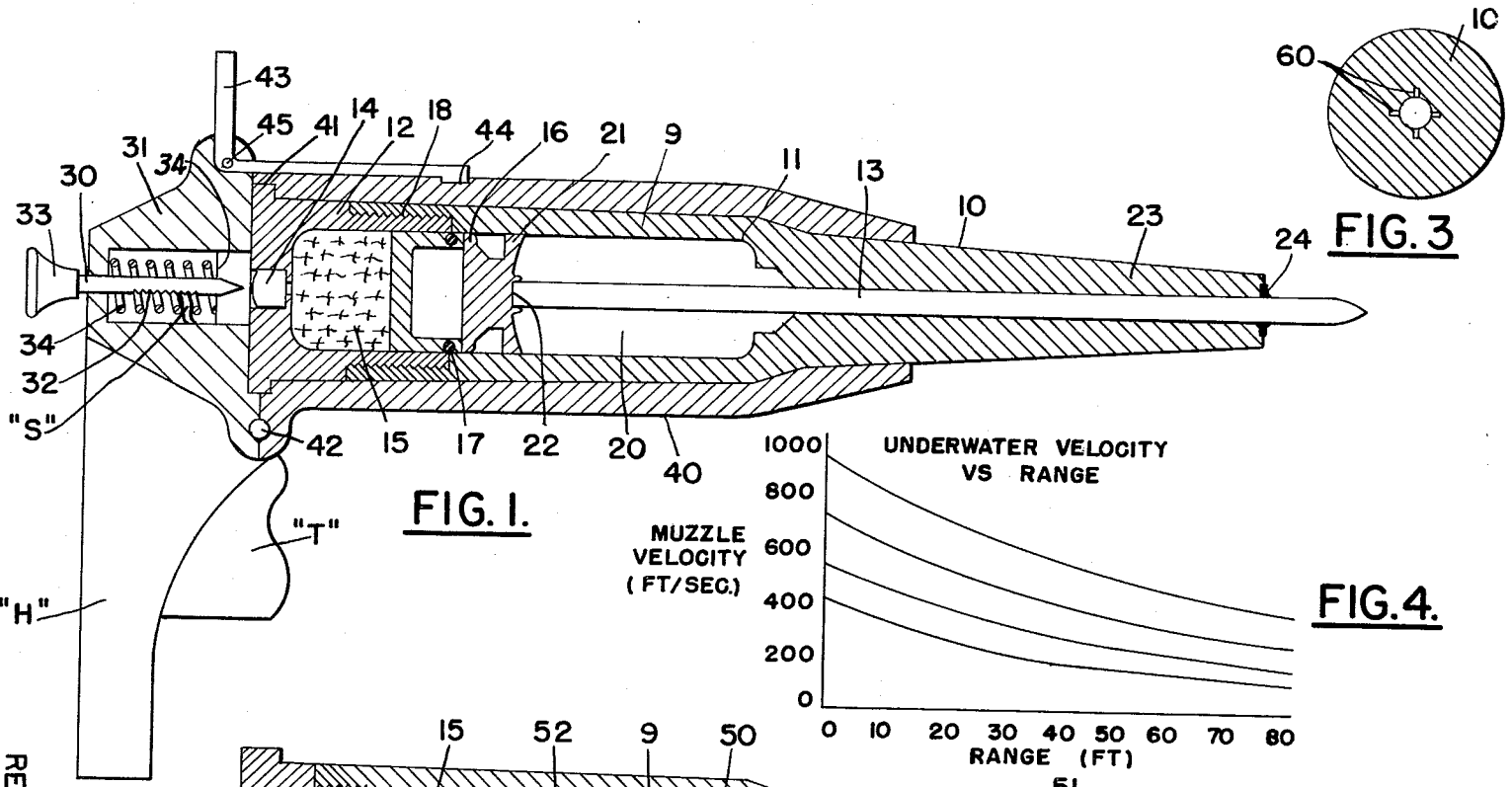
FIG. 3
FIG. 1.
FIG. 4.
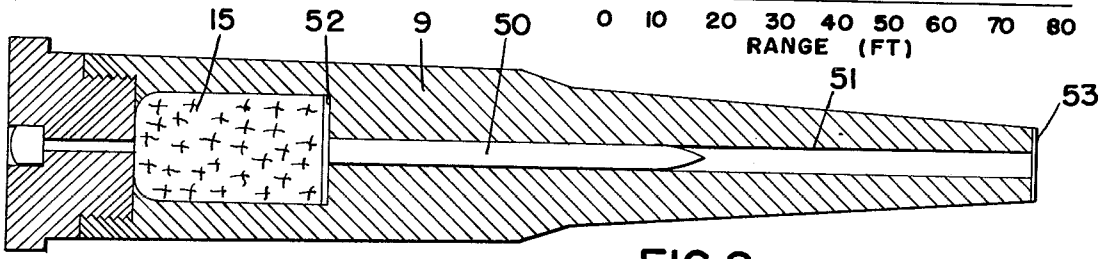
FIG. 2.
INVENTORS,
REED E. DONNARD
EDWARD R. HIRSEKORN
BY S. J. Potenti, Jr.,
A. T. Dupont & S. Rubaff
ATTORNEYS:

UNDERWATER SIDE ARM

The invention described herein may be manufactured and used by or for the Government for governmental purposes without the payment to us of any royalty thereon.

This invention relates to weapons and more particularly concerns a hand held sidearm to be used principally under water and wherein projectiles may be safely and effectively propelled therefrom by means of high energy propellants.

The coming prominence of atomic submarine warfare with the resultant expanded activities of frogmen have increased the possibility of underwater person to person combat. Existing underwater hand weapons for swimmers depend upon mechanical springs, carbon dioxide gas, compressed air, hydraulic accumulators, etc., for propulsive force. The overall length of these weapons approximate 3 feet. Their weight is about 5 pounds and their effective range only about 12 to 20 feet. These weapons offer little military advantage to an underwater swimmer because of their limited range and clumsiness. Despite its need, no major emphasis has been placed on equipping these swimmers with a weapon for offensive and defensive maneuvers against fish life and enemy underwater swimmers. Our inventive weapon system offers vastly increased projectile range and striking power in a greatly reduced weapon system package.

It is therefore a broad object of the present invention to provide an improved hand held device capable of firing projectiles and the like.

Another object of the invention is to provide an underwater side arm having increased range and striking power and yet is compact and light in weight when compared with other weapons of this type.

Still another object of the invention is to provide a weapon as aforedescribed wherein its internal ballistic cycle is unaffected by any retarding forces due to its aqueous environment.

Other objects and many of the attendant advantages of this invention will be readily appreciated as the same becomes better understood by reference to the following detailed description when considered in connection with the accompanying drawings in which like reference numerals designate like parts throughout the figures and wherein:

FIG. 1 is a longitudinal section of a preferred embodiment of our inventive device;

FIG. 2 is a longitudinal section of a modified cartridge-barrel assembly of our invention;

FIG. 3 is a transverse section of a modified cartridge-barrel assembly showing a grooved barrel for accommodating fixed fin projectiles; and FIG. 4 graphically represents underwater projectile velocity against range.

Referring to the drawings and more particularly to FIG. 1 thereof, there is shown a hand held side arm including an expendable cartridge-barrel assembly comprising a thick-walled rigid cartridge casing 9 providing a barrel 10 having a wall thickness at least equal to about the diameter of the bore therein and an internal shoulder 11, a retainer 12, projectile 13, primer 14, propellant 15, piston 16 and O-ring 17. Retainer 12 is screwthreadedly mounted to the cartridge casing at 18 and contains the propellant which may suitably be of the single or double base type, although not limited thereto. Piston 16 is seated within a chamber 20, formed by the casing 9 and retainer 12, and includes a shoulder portion 21 adjacent its forward end, which has a recess 22 disposed centrally therein. The rear end of the projectile 13 is carried in the recess 22 and its forward end extends along barrel 10 and beyond the neck portion 23 of casing 9. A seal 24, made of polyethylene, for example, is affixed to the end of the barrel to prevent the entry of water into the barrel or chamber.

Arranged around the outer periphery of piston 16 and intermediate its ends, is O-ring 17, such that, upon ignition of propellant 15, the piston is caused to move forwardly and thus expanding the O-ring against the inner wall of casing 9 to prevent leakage of any combustion gases past the O-ring.

Primer 14, waterproofed by any one of the standard sealants such as case lacquer, contains a lead styphnate type priming mixture, for example, and is disposed rearwardly of retainer 12 and communicates with propellant 15 and with a firing pin 30 carried in firing pin housing 31. Pin 30 is notched at 32 for engaging a sear S, co-acting with trigger T affixed to handle H, the pin being manually armable when firing pin handle 33 is pulled back to cause compression of spring 34 by means of spring retaining disc 34' secured to pin 30.

A rigid cartridge holder 40, which forms no part of the expendable cartridge-barrel assembly, receives a portion of this assembly as indicated clearly in the illustrative embodiment of FIG. 1. The cartridge holder is shown recessed at 41 for engagement with a rear flanged portion of retainer 12, but may optionally have a plurality of spaced projections extending radially inwardly from its inner periphery for mating corresponding depressions provided around the retainer.

Cartridge holder 40 is shown connected to firing pin housing 31 by a pivot pin 42 for permitting our inventive small arm to be broken upon disengagement of locking lever 43 from a slot 44 provided on the outer wall of holder 40, the locking lever being pivotally mounted at 45 to the firing pin housing. Optionally, and in lieu of the pivot pin setup shown generally at 42, connections between the cartridge holder 40 and firing pin housing 31 may be accomplished equally well by means of interrupted threads and the like.

The modified expendable cartridge barrel assembly shown in FIG. 2 is characterized by its simplicity and low cost. It is adapted for use with the aforedescribed device and is comprised generally similar. Projectile 50, however, is completely frictionally fitted within the barrel 51 and has its rear end in contact relation with a seal 52 covering the front face of propellant 15. The cartridge casing 9 is completely sealed as indicated at 53, and, optionally, the bore of the barrel may be partially evacuated to lessen any disturbing influence on the projectile upon firing.

In FIG. 3, the bore of the barrel 10 has a plurality of spaced longitudinal grooves 60 disposed along its entire length to accomodate fixed fin projectiles to impart stability to the projectile in flight. It is to be understood, of course, that each of the aforedescribed cartridge-barrel assemblies may similarly be grooved if fixed fin projectiles are to be employed.

It is apparent from the graph of FIG. 4 that out inventive weapon vastly increases underwater projectile ranges. For example, at a range of 80 feet, the projectile is travelling over 300 ft./sec. when the muzzle velocity approximates 900 ft./sec. When the muzzle velocity is only 400 ft./sec., the projectile is still travelling about 150 ft./sec. at a point 80 feet from the weapon. When a 0.5 inch diameter projectile is used, its cylinder length will be approximately 5½ calibers and projectile weight will be about 2200 grains. If the projectile diameter is reduced to 0.3 inches, the cylinder length will approximate 9½ calibers and its weight almost 1300 grains. Those skilled in the art will appreciate the projectile design parameters involved for different caliber projectiles.

In the operation of our inventive side arm, the entire cartridge-barrel assembly is inserted through the cartridge holder 40 and the locking lever caused to engage the cartridge holder slot, all as shown in FIG. 1 of the drawings. When the propellant is ignited, the piston is urged forwardly to expand the O-ring against the inner wall of the casing as aforementioned. The piston however is free to continue its forward movement to impart a forward velocity to the projectile. The piston and projectile continue to accelerate until the piston shoulder meets the casing's internal shoulder. The piston shoulder, which is made of a light metal, such, for example, as aluminum or titanium, will be caused to deform rearwardly upon contact with the casing shoulder, and thus preventing any further substantial forward movement of the piston. The velocity attained by the projectile at this point will cause it to leave the barrel and on toward the target.

In the modification shown in FIG. 2, the gas pressure produced upon ignition of the propellant is sufficient to impart a forward motion to the projectile, and thus creating a moving air column ahead of the projectile for rupturing the front seal and permitting the projectile to leave the barrel. It is thus seen that the internal ballistic cycle will take place devoid of any aqueous environment. Irrespective of the type cartridge-barrel assembly used, ejection will be accomplished by simply pushing the cartridge-barrel assembly rearwardly when the weapon is in its broken condition.

In the practice of out inventive side arm, the design of the projectile will be such that minimum drag will be encountered with the water. It should possess high sectional density such as a spear of the flechette type in order that maximum effective range of the projectile will be obtained upon ignition of the high energy propellant. Additionally, the projectile can be made recoverable if desired by securing a wound retrieving line, for example, between the projectile and the cartridge holder.

From the foregoing description it will be apparent that we have provided a compact side arm having a unique expendable cartridge-barrel assembly capable of propelling a projectile by means of high energy propellants, and having an effective underwater range well above 50 feet, the limit of underwater visibility, even under ideal conditions.

The device is obviously less cumbersom than spear guns and the like and can be made relatively light in weight by a judicious selection of materials employed. Further, the internal ballistic cycle is unaffected by its aqueous surroundings due to the novel sealing system employed therein.

It is to be understood, of course, that our device is capable of functioning above water as a normal weapon having silent operational characteristics. Thus, our device will significantly improve frogmen mission capabilities by providing a weapon having dramatically augmented underwater characteristics and silent out-of-water operation.

We claim:

1. A device including an expendable cartridge-barrel assembly comprising a cartridge casing forming a barrel, the wall thickness of said barrel being at least equal to about the diameter of the bore therein, a retainer affixed to and rearwardly of said casing, a high energy propellant enclosed within said assembly, a primer within said retainer and communicating with said propellant, a projectile frictionally fitted within and extending along the bore of said barrel and having a rear end in proximate relation to said propellant, said projectile being designed for high sectional density and minimum drag with water, and a watertight seal affixed to a front end of said cartridge-barrel assembly.

2. An underwater side arm comprising a cartridge holder for slidably receiving said device of claim 1, the barrel of said device extending through said cartridge holder and the retainer of said device seated in an end of said cartridge holder, and means pivotally mounted on said cartridge holder for actuating the primer of said device.

3. The device of claim 1 further characterized by said casing and retainer forming a chamber, the forward end of said chamber being adjacent to an internal shoulder shaped in said casing, said propellant being contained within said retainer and communicating with said primer, a piston movable within said chamber and contacting said propellant, a flanged shoulder integral with a forward portion of said piston and having a recess disposed centrally thereat, said projectile having its rear end seated in said recess, and its remaining portions extending through said chamber, into and beyond said barrel and a water-tight seal at a front end of said barrel.

4. The device of claim 2 further characterized by said actuating means comprising a firing pin.

5. The device of claim 1 further characterized by said barrel having a bore providing spaced longitudinal grooves for accommodating a fixed fin projectile.

6. Apparatus as described in claim 3 wherein said piston includes an O-ring disposed about an outer periphery generally intermediate its ends.

7. In combination with an underwater side arm, an expendable cartridge-barrel assembly comprising a cartridge casing forming a barrel at one end, a retainer screw-threadedly mounted to the other end of said casing and providing a primer support, a propellant within the casing and adjacent the primer support, a water-tight seal affixed to a front end of said barrel and a water-tight seal affixed to a front face of said propellant, a projectile frictionally fitted within and extending along the bore of said barrel and having its rear end contacting said water-tight seal affixed to the front face of said propellant, said projectile being designed for high sectional density and minimum drag with water.

8. An underwater side arm including an expendable cartridge-barrel assembly comprising a casing forming a barrel at one end, a retainer mounted on the other end of said casing, a primer supported and contained within said retainer, said casing and retainer forming a chamber therebetween, an internal shoulder shaped in said casing adjacent a forward end of said chamber, a propellant within said chamber communicating with said primer, a piston movable within the chamber having a rear portion contacting the propellant, an O-ring disposed about an outer periphery of said piston generally intermediate its ends, a flanged shoulder integral with a forward portion of said piston and having a recess disposed centrally thereof; a projectile having its rear end seated within said recess and its remaining portions extending through the chamber, through the bore of said barrel, through a water-tight seal affixed to a forward end thereof and terminating at a point beyond said forward end; a firing pin aligned with said primer, a housing for supporting said firing pin, a cartridge holder surrounding said cartridge-barrel assembly generally about its chamber, a swivel connection between the firing pin housing and cartridge holder adjacent their lower portions, means for locking said firing pin housing to said cartridge holder and means for spring loading and releasing said firing pin.

* * * * *